US005968231A

United States Patent [19]

Parmentier et al.

[11] Patent Number: 5,968,231

[45] Date of Patent: Oct. 19, 1999

[54] CYCLONE EXCHANGER WITH TRANQUILIZING TANK AND METHOD FOR PURIFYING AND DECONTAMINATING AIR

[75] Inventors: Michel Parmentier, Vaudeville; Jean-Charles Weber, Dombasle, both of France

[73] Assignee: Grignotage, (SARL), Dombasle, France

[21] Appl. No.: 08/926,121

[22] Filed: Sep. 9, 1997

Related U.S. Application Data

[63] Continuation of application No. 08/507,347, filed as application No. PCT/FR94/01469, Dec. 15, 1994, abandoned.

[51] Int. Cl.[6] ..... B03C 1/023

[52] U.S. Cl. ..... 95/28; 95/64; 95/67; 95/71; 95/75; 96/3; 96/50; 96/52; 96/61; 96/74

[58] Field of Search ..... 95/28, 63, 67, 95/73, 71, 72, 64, 78, 75; 96/3, 55, 57, 61, 52, 53, 74, 50

[56] References Cited

U.S. PATENT DOCUMENTS

| | | | |
|---|---|---|---|
| 1,773,840 | 8/1930 | Nattcher et al. | 96/61 |
| 1,843,839 | 2/1932 | Ruder | 96/61 |
| 2,081,772 | 5/1937 | Saint-Jacques | 96/61 X |
| 3,875,061 | 4/1975 | Palma | 96/61 X |
| 4,046,527 | 9/1977 | Kistemaker | 96/3 |
| 4,957,520 | 9/1990 | Parmentier et al. | 55/467 X |

FOREIGN PATENT DOCUMENTS

| | | | |
|---|---|---|---|
| 338960 | 10/1989 | European Pat. Off. . | |
| 1960097 | 6/1971 | Germany | 96/61 |
| 1465086 | 3/1989 | U.S.S.R. | 96/61 |

OTHER PUBLICATIONS

Uchida, Satoshi, Patent Abstracts, Japan Patent No. 1–111460, Apr. 28, 1989.

Gas Scrub, Patent Abstracts, U.S.S.R. Patent No. 994011, Feb. 7, 1983.

*Primary Examiner*—Richard L. Chiesa

*Attorney, Agent, or Firm*—Weiser and Associates P.C.

[57] ABSTRACT

A device and a method for purifying and decontaminating air uses an exchanger of the cyclone type and furthermore employs a combination of the action of cyclonic centrifugation and the action of at least one path enhancing field. A tranquilizing chamber, which is separated from the cyclone exchanger by a vent, maintains a volume of liquid into which particles and droplets are received from the peripheral wall. To this end, particulates are partially electrified before entering the enhancing field.

16 Claims, 1 Drawing Sheet

CYCLONE EXCHANGER WITH TRANQUILIZING TANK AND METHOD FOR PURIFYING AND DECONTAMINATING AIR

This is a continuation of copending application Ser. No. 08/507,347, filed on Aug. 15, 1995 (now abandoned), which was the National Stage of International Application No. PCT/FR94/01469 filed Dec. 15, 1994.

BACKGROUND OF THE INVENTION

The invention present invention relates to a device for purifying and decontaminating air.

In numerous industries, particularly including the electronics industry, coatings, foods, pharmaceuticals, hospitals, cell cultures, etc., control of the quality of the air in terms of particle content is an absolute necessity. Particulate and microbiological contamination are moreover linked, since it is now known that the micro-organisms present it the environment are almost always attached in the form of biofilms to the particles present in the air, which then serve as a support.

It should also be considered that one particle in 10,000 is associated with biocontaminant presence. It is therefore not surprising that systems for microbiological sanitation of the environment in industries in which the process demands it, are entirely bound to the control of the particulate content of the air.

The parameters which make it possible to monitor this bacteriological content of the air call upon either physics (filtration supplemented with bactericidal action, by UV, ionization, etc.) or chemistry for disinfection (aerosols, bactericides, fumigation, etc.) or usually a combination of the two (i.e.) filtration supplemented with backup from a bactericide).

In most of the solutions currently developed, filtration remains the basic method which makes it possible to limit the number of particles per unit volume and hence, by a proportionate effect, the associated microbiological contamination. These systems have the major drawback of rapidly becoming fouled, and hence of requiring substantial renewal costs if their efficiency is not to see a rapid and irreversible decline.

SUMMARY OF THE INVENTION

To overcome the drawbacks of existing systems, the present invention uses the principle of exchangers of the cyclone type (also called coil-type cyclone exchangers), augmented to achieve the desired degree of control of the quality of the air.

An application of this type of cyclone exchanger to the trapping of fumes above a cooking apparatus is already known. This application is described in French Patent 2,630,029 and the corresponding patents U.S. Pat. No. 4,957,520 and EP-0,338,960.

The present invention has more extensive applications and makes it possible to achieve much better air quality.

These objectives are achieved with a device for purifying and decontaminating air using an exchanger of the cyclone which furthermore includes a means of combining the action of cyclonic centrifugation and the action of at least one path enhancing field on partially electrified particles before entering the enhancing field.

The process of the present invention resides in the judicious combining of individually known physical principles which, when combined into a single system, make it possible to obtain a very high efficiency in dust-removal and hence in microbiological cleansing. As in the case of the above-cited French Patent, the present sanitation apparatus is self-cleaning since it does not itself accumulate any pollution by virtue of the trickling of condensates.

According to the present invention, the system combines a coil-type cyclone exchanger effecting a phase change in the treated air and an enhancing of paths enabling the particles to be channelled toward the periphery of the exchanger through the action of a magnetic field and/or an electric field. The particles are previously ionized by crossing through a sufficiently powerful ionizer stationed in the tangential inlet. The ionized particles then become sensitive to the magnetic and/or electric fields which will enhance their removal toward the periphery of the exchanger, where they will become trapped by the trickling of condensates on the coils and on the walls of the exchanger.

The magnetic field is generated by supplying turns with continuous current so as to create an axial induction in the body of the cyclone.

The electric field is, for its part, obtained by the positive polarization of conducting plates stationed (and insulated) on the periphery of the body of the exchanger and a negative terminal stationed inside the outlet guide of the cyclone. In this way, the electric field created is always centripetal, and therefore channels the particles ionized at the inlet toward the periphery.

In the case where the treated air is not sufficiently humid to create this trickling, humidification by inlet-nozzle injection makes it possible to provide the air with a humidity content adequate to obtain the desired trapping after cyclonization.

The particles then cluster together and are no longer rejected by the dehumidified turbulent air emerging from the central vortex. This particular arrangement considerably improves the efficiency of the trapping of the finest particles by enhanced centrifugation and wet clustering.

At the base of the cyclone, the entrained particles pass into a recovery chamber with a geometry which engenders a sharp reduction in velocity. The particles then fall into the condensate (water), the level of which is kept constant by the operation of a syphon.

This configuration, which according to the present invention employs centrifugation enhanced by the action of the axial magnetic and/or centripetal electric field, condensation and clustering, and then channelling toward the widened base, enables the system to not accumulate any pollution in regions in contact with the air to be treated. The trickling draws the polluting content toward a tranquilizing chamber, where it is removed by the syphon.

The invention will be better understood with the aid of the description which follows, with reference to the appended figures.

DETAILED DESCRIPTION OF PREFERRED EMBODIMENTS

Figure 1:
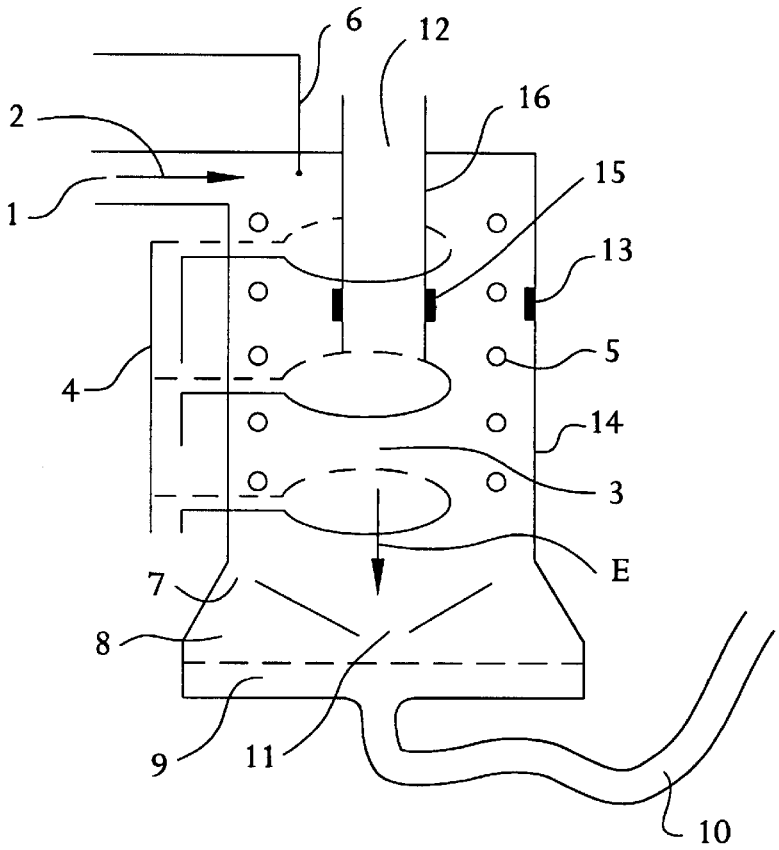
FIG. 1 is a diagrammatic sectional view of an embodiment of the invention.
Figure 2:
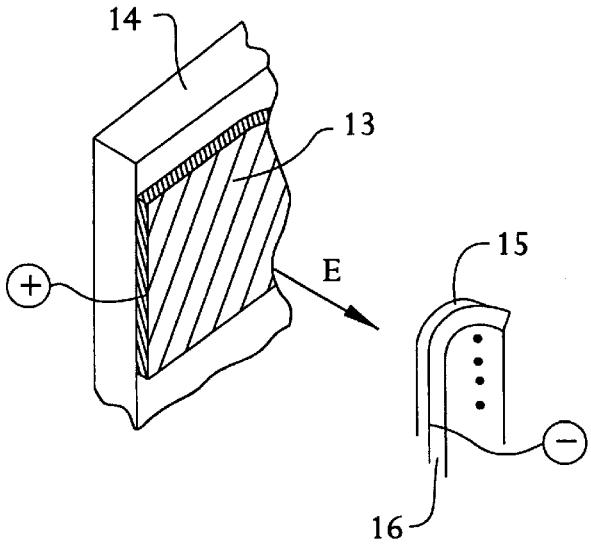
FIG. 2 is a diagrammatic partial view of an embodiment for producing an electric field used in the invention.

In the embodiment illustrated, the particle-laden air enters the tangential inlet (1). This air then crosses an axial ionizer (2) formed, for example, of a heated emitter filament and an axial cylindrical collector surface. Entry into this section gives rise to partial ionization of the air, the electric charge preferably being taken up by the particles present, inert or not. The charged air then enters the cyclone (3) where it undergoes a conventional cyclonic motion during which the electrified particles are subject to the action of an axial magnetic field and/or a centripetal radial electric field (E). The magnetic field is created by conducting turns fed from a rack (4) traversed by a suitable continuous current. The radial electric field is created by energizing a capacitor comprised of positive plates (13) stuck to the internal face of the wall of the exchanger (14) and opposing negative plates (15) stuck to the central air collector (16). The magnetic and/or electric fields enhance the naturally spiraling path of the particles in the cyclone and lead to particularly efficient channelling of the particles toward the periphery of the cyclone, this irrespective of their size. This phenomenon is fundamental since it makes it possible to considerably decrease the cutoff threshold of the cyclone in terms of the limiting diameter of the arrested particles. At the periphery, the particles are brought into contact with the cold coil (5), on which there occurs condensation of the water present naturally (via the humidity of the environmental air), or possibly injected at the inlet by way of the nozzle (6). The particles are then trapped by the condensate (water), clumped and ejected together with the water droplets onto the lateral surface (14) of the cyclone, down which they trickle. This trickling effects a dual function, trapping of the particles and self-cleaning of the body of the exchanger.

A separator grate device makes it possible to physically separate the chamber (3) from the condensate recovery chamber (8). This device can advantageously be added a few millimetres from the internal lateral surface of the cyclone. At the base of the cyclone, the particles and the associated water droplets pass into the tranquilizing chamber (8) through the vents (7). As a result, the velocity drops considerably and becomes almost zero. The particles are then trapped at the water surface (9) resulting from the condensation, the level of which is kept constant by the operation of the syphon (10). At the same time, the scrubbed air is directed by the deflector (11) toward the outlet vortex (12) of the cyclone.

At the outlet of the device, a system of dry filters may advantageously supplement the purification, depending on the class of air desired. The operation of the filters is then greatly improved as compared with a system of direct filtration. The air is cleansed and dehumidified on entering the filters, thus greatly diminishing their fouling and prolonging the optimal duration of use. Maintenance and upkeep of the systems are then appreciably reduced.

The system according to the present invention may usefully be employed alone (if the air required is of class 40,000 in the sense of norm NF×44 101-), or in association with a bank of supplementary filters in order to achieve class 4,000. The areas of application are therefore enormous, including microbiologically monitored rooms in the food or pharmaceutical industry, clean rooms in the components and surfaces industry, sterile rooms in the hospital industry, etc.

It may also advantageously prepare supplementary filtration leading to sterile air sought for certain applications.

It should be noted that in the major part of the food industry for example, the system according to the present invention will suffice on its own, to achieve the required reduction in humidity and in bacterial content. This, for example, is the case for production rooms in dairies, salting plants, abattoirs, etc.

We claim:

1. A device for purifying and decontaminating air comprising a cyclone exchanger having means for causing cyclonic centrifugation of the air in combination with means for exposing the air to at least one cyclone path enhancing field, wherein the air is partially electrified before entering the enhancing field, wherein the cyclone exchanger has cooling means coupled to a peripheral wall of the cyclone exchanger, wherein the enhancing field operates to direct the partially electrified air radially outwardly toward the peripheral wall of the cyclone exchanger, and further comprising a tranquilizing chamber separated from the cyclone exchanger by a vent and adapted to maintain a volume of liquid into which particles and droplets are received from the peripheral wall.

2. The device of claim 1 wherein the enhancing field is an axial magnetic field.

3. The device of claim 2 which further includes a plurality of electrically conducting turns for receiving a continuous current so that the axial magnetic field is induced in the conducting turns.

4. The device of claim 2 wherein the enhancing field further includes a radial electric field in combination with the axial magnetic field.

5. The device of claim 1 wherein the enhancing field is a radial electric field.

6. The device of claim 5 which further includes a plurality of polarized plates for developing a centripetal electric field between an inner wall of the cyclone exchanger and the peripheral wall.

7. The device of claim 1 which further includes an axial ionizer located at an inlet of the cyclone exchanger, for electrifying the air entering the inlet.

8. The device of claim 7 wherein the inlet includes a heated central filament and a cylindrical collector casing.

9. The device of claim 1 wherein the cooling means is a coolant fluid circulating through a coil which operates as a condenser, thereby causing a trickle of water droplets which effects a dual role of particle trapping and self-cleaning of the cyclone exchanger.

10. The device of claim 1 which further includes a deflector for directing scrubbed air to an outlet vortex of the cyclone exchanger.

11. A method for purifying and decontaminating air in a cyclone exchanger including cooling means coupled to a peripheral wall of the cyclone exchanger, and means for causing cyclonic centrifugation of the air, the method comprising the steps of partially electrifying the air, and exposing the partially electrified air to at least one cyclone path enhancing field in combination with the cyclonic centrifugation, wherein the enhancing field operates to direct the partially electrified air radially outwardly toward the peripheral wall of the cyclone exchanger, on which droplets form carrying particles into a tranquilizing chamber separated from the cyclone exchanger by a vent and adapted to maintain a volume of liquid into which the particles and droplets are received from the peripheral wall.

12. The method claim 11 wherein the enhancing field is an axial magnetic field.

13. The method of claim 12 wherein the enhancing field further includes a radial electric field in combination with the axial magnetic field.

14. The method of claim 11 wherein the enhancing field is a radial electric field.

15. The method of claim 11 which further includes the step of electrifying the air in an axial ionizer located at an inlet of the cyclone exchanger.

16. The method of claim 11 wherein the cooling means operates as a condenser, causing a trickle of water droplets which effects a dual role of particle trapping and self-cleaning of the cyclone exchanger.

* * * * *